US005429329A

United States Patent [19]

Wallace et al.

[11] Patent Number: 5,429,329

[45] Date of Patent: Jul. 4, 1995

[54] ROBOTIC RAILROAD ACCIDENT PREVENTION VEHICLE AND ASSOCIATED SYSTEM ELEMENTS

[76] Inventors: Charles C. Wallace, 1925 McDowling Dr., Huntsville, Ala. 35803; Charles P. Swanson, 102 Calhoun St., Huntsville, Ala. 35801

[21] Appl. No.: 188,884

[22] Filed: Jan. 31, 1994

[51] Int. Cl.[6] ..... B61L 1/00

[52] U.S. Cl. ..... 246/166; 246/121; 246/126; 246/182 B; 246/187 C; 246/473.1; 340/902; 340/501; 73/602

[58] Field of Search ..... 246/120, 121, 125, 126, 246/166, 182 R, 182 B, 187 R, 187 C, 202, 473.1; 340/902, 436, 438, 501, 669; 73/587, 602

[56] References Cited

U.S. PATENT DOCUMENTS

| | | | |
|---|---|---|---|
| 1,014,552 | 1/1912 | Wolper | 246/166 |
| 3,906,442 | 9/1975 | Mosteller | 340/431 |
| 4,108,405 | 8/1978 | Gibson | 246/125 |
| 4,578,665 | 3/1986 | Yang | 246/121 X |
| 4,578,754 | 3/1986 | Sahasrabudhe et al. | 364/426.05 |
| 4,942,395 | 7/1990 | Ferrari et al. | 246/126 X |
| 5,098,044 | 3/1992 | Petit et al. | 246/126 X |
| 5,386,727 | 2/1995 | Searle | 73/602 |

FOREIGN PATENT DOCUMENTS

| | | | |
|---|---|---|---|
| 2631654 | 12/1977 | Germany | 246/166 |

*Primary Examiner*—Robert J. Oberleitner
*Assistant Examiner*—S. Joseph Morano

[57] ABSTRACT

A robotic vehicle (10) is shown with conventional train flanged wheels (11) riding upon common railroad tracks (12). The body (13) of the vehicle encloses a conventional diesel electric power unit (14) with speed characteristics comparable to the train it precedes. The power unit (14) is controlled by a computer program, but has remote control override provisions in the software as directed by the engineer in the locomotive cab following the robotic vehicle (RV). The RV (10) has a television camera (15) viewing the track ahead and a transmitter (16) for sending the video signal to the locomotive cab's TV monitor (17)/video cassette recorder (18). The range and power of the electromagnetic wave exchange directly between the RV and cab will be low power broadcasts and signal frequencies as assigned by the FCC. The RV has safety sensors as described in the detailed description which display warnings in the locomotive cab for the engineer to apply the train's brakes in time, thus preventing an accident, since the distance between the train and the RV is approximately 1 to 2 miles.

5 Claims, 6 Drawing Sheets

ROBOTIC RAILROAD ACCIDENT PREVENTION VEHICLE AND ASSOCIATED SYSTEM ELEMENTS

STATEMENT OF THE INVENTION

The present invention provides a robotic vehicle remotely controlled traveling at approximately 1 to 2 miles in front of a passenger train or in front of a freight train with toxic or hazardous chemicals. This robotic vehicle is outfitted with sensors to detect obstacles upon the railway and deformities in the rails. This information is conveyed to the engineer in the locomotive cab of the train behind by means of electromagnetic wave transmission. This information is recorded and acted upon by the train's engineer with the choice of manual or automatic mode in applying the train's brakes.

Accordingly, it is an object of the present invention to prevent an accident involving the train and its personnel by giving advance warning of track hazards. The object also includes video recording and storing in computer memory certain parameters of any accident involving the robotic vehicle.

Another object is to provide an economical method of accident prevention at non-gated railroad crossings by providing a remote controlled warning light pole at the crossing initiated by the robotic vehicle.

Yet another object of the invention is to provide a means to determine which railway bridges should be inspected for structural integrity on a timely basis. This object being by recording acoustic wave echo patterns as the robotic vehicle crosses the bridge structure and transmitting this data to a central receiving station along with position via satellite. This set of echo patterns is compared with subsequent recordings for identification of significant structural changes.

DETAILED DESCRIPTION OF THE INVENTION

Figure 1:
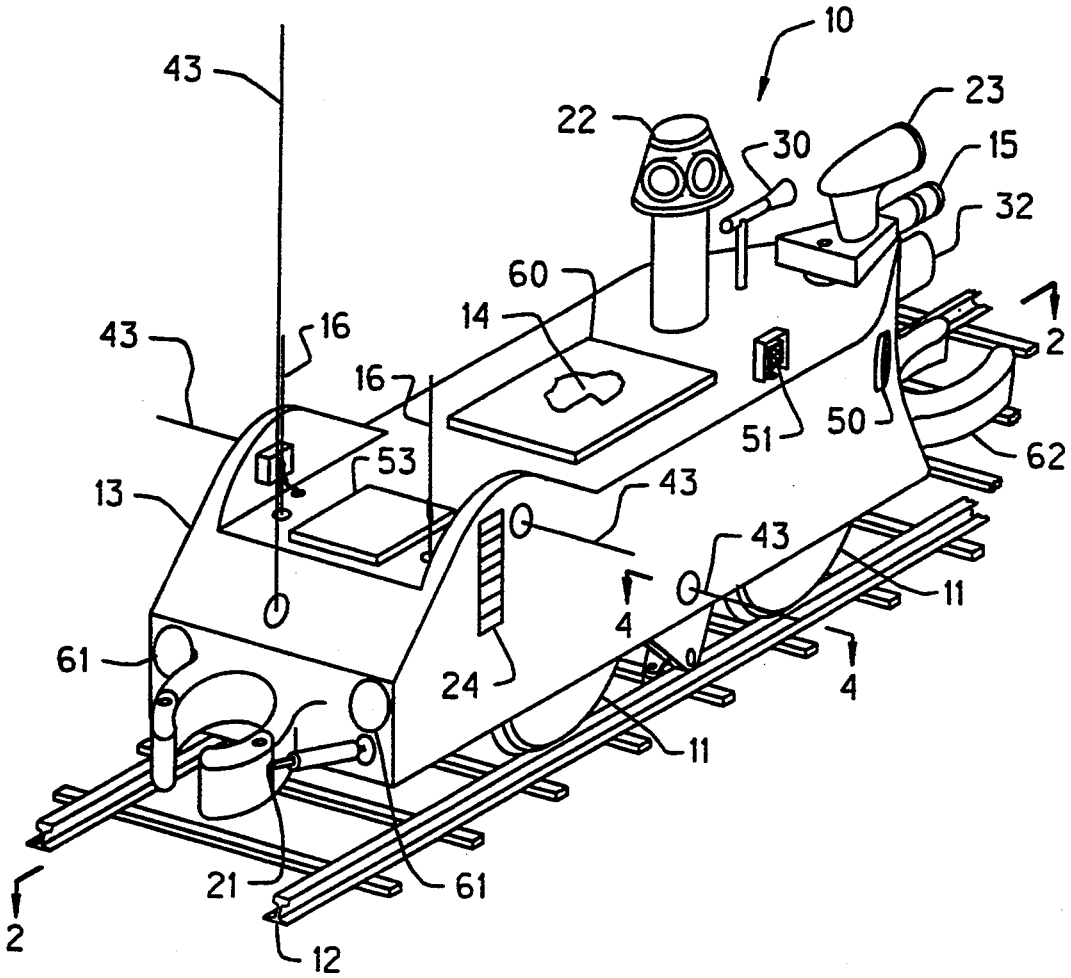
FIG. 1 is a pictorial view of the robotic vehicle on the roadway.

Referring to the drawings, FIG. 1 shows the robotic vehicle 10 alone on the roadway 12. The vehicle is powered by a diesel-electric power unit 14 riding on conventional train flange wheels 11. The access for maintenance and re-fueling is shown by the access hatch 60. The vehicle's safety features (described in more detail below) in part can be seen in this pictorial view of FIG. 1. They include the television camera 15 pointed with its viewing area straight ahead and the head light 23 mounted on the camera assembly. The camera assembly with the headlight can be rotated 90° counterclockwise and 180° clockwise at the discretion of the engineer by remote control. The horn 30 can be operated by the engineer at anytime, but is used also by the computer program when approaching road crossings. The height and side clearance feeler rods 43 are shown. The transmitting and receiving antenna 16 are shown mounted on the top rear of the vehicle. The housing for the air bag 32 can be seen at the front of the vehicle which is deployed under crash conditions. Atop the vehicle, near the front is the rotating warning light 22. The body 13 of the vehicle has reflectors 61 at rear. The train car coupler 62 at the front is for handling circumstances in the railyards. The special coupler 21 at the rear is for attaching to the train's locomotive.

The operational mode of the robotic vehicle is that it is coupled to the front of the locomotive as it leaves its point of origin. The robotic vehicle remains coupled with the locomotive when going through the classification or hump yard, but has its own identification label 24 of color codes which are read by the electric eye scanners for car classification.

When the train has left the station, switch yard, and/or populated gated railroad crossing areas, the engineer according to pre-planned procedures will activate the robotic vehicle 10 by throwing a switch 20 on the instrumentation console 19 in the locomotive cab. The TV monitor 17 and VCR 18 automatically is started by the computer program within the console at this point. The manual controls 63 for the monitor and VCR are shown below on the console 19.

The computer program immediately erases from memory any previously recorded data and rewinds the VCR tape, then sets VCR and computer memory to record this trip by the robotic vehicle.

The switch 20 also activates the systems and computer program aboard the robotic vehicle. The television camera 15, rotating warning light 22, and headlight 23 are on at this point. The safety sensors and transmitting/receiving antenna are operational. The special customized coupler 21 on the rear of the vehicle is decoupled in sequence as controlled by the RV's computer program of engine start, speed setting and engaging the electric drive mechanisms. The RV speeds ahead of the train to take up a monitoring position approximately 1 to 2 miles in front on the roadway. If an accident occurs with the RV 10, the VCR 18 records the event for later analysis in determining the official cause of the accident by investigative bodies.

The train, before releasing the RV 10, forms a red block in the railroad industry's block signal system. When the RV speeds ahead to take up its position matching the speed of the following train, it expands the train's length from a one block train to a two red block train. The train, if equipped with ATS (Automatic Train Stop) or ATC (Automatic Train Control) would be (by the engineer) switched off 64 on the console 19, and this automatically switches on the RV's automatic braking system as controlled by ATS/ATC. The RV 10 would automatically slow down or stop as it receives commands by those automated block signal systems or CTC (Centralized Traffic Control. The commands would automatically be relayed from the RV to the train for it to obey automatically the same commands. The switches 20 to activate RV, automatic train braking 35 as controlled by RV, and ATS/ATC control 64 as relayed by RV, have corresponding indicator lights 65, 66, 67 on the console 19 to show switch position modes. These lights are split with the lighted portion always indicating the mode position of the corresponding switch. Switch 71 is the main power for the instrumentation console 19.

An operational description of various scenarios follows.

When the RV 10 approaches a gated railroad crossing, the closing of the road occurs the same as a normal train approaching. The RV is preceding the train by approximately two minutes, so the time the road is closed at the crossing is increased from the time interval the train would normally use. The RV can be programmed to reduce its distance in front of the train in order to reduce the time a gated crossing is closed at a heavy traffic road. But depending on the speed of the train, the number of cars in the train and its classification make-up, the distance between the train and the RV has to remain sufficient to allow the train to come to a complete stop before it reaches the track position held by the RV when it issued its hazard warning.

Figure 6:
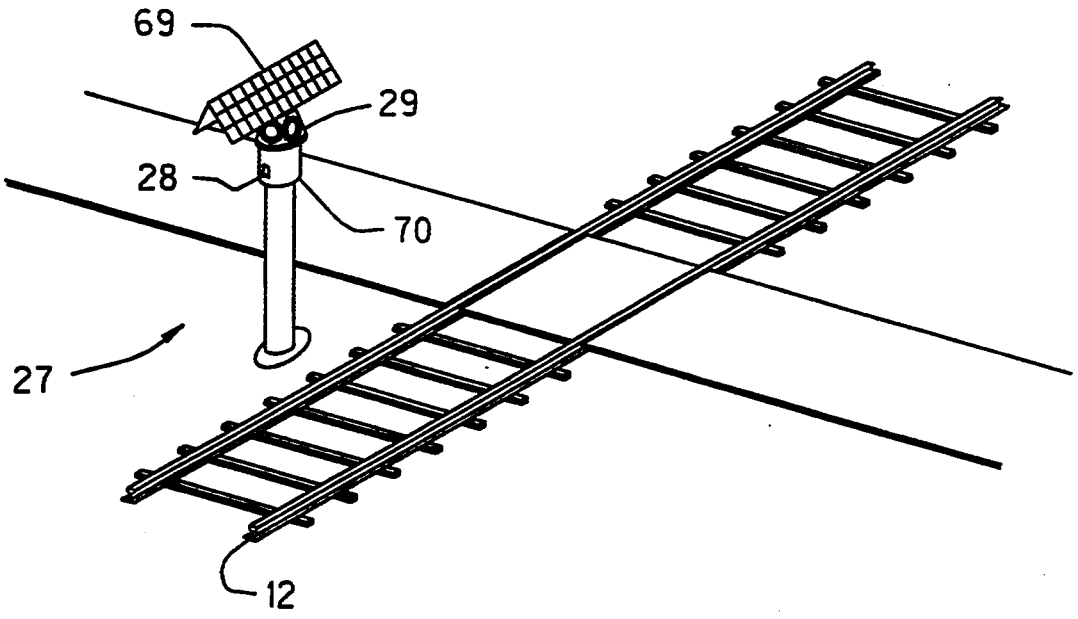
FIG. 6 is a view of a non-gated rural area railroad crossing with a system element of the invention being a warning light mounted on a pole embedded in concrete having solar panels atop the pole and a rechargeable battery pack below the light. Also housed in the battery pack is a five minute timer control and a remote signal receiver for timer initiation.
Figure 7:
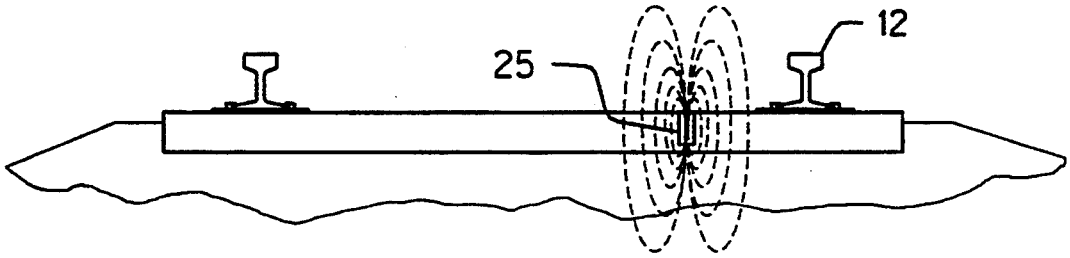
FIG. 7 is an elevation sectional view through a roadbed, crossties and train rails. Shown to the right side is a bar magnet encased in plastic and embedded in the crosstie used to initiate a remote signal to light mounted pole.

When a non-gated railroad crossing is approached, the RV 10 encounters the magnetic field of the embedded magnet 25 on the right side as shown in FIG. 7. A wire 26 on the RV crosses this field and electrically triggers through the computer 41 its remote ultrasonic signal unit to emit a signal towards the light pole assembly 27 shown in FIG. 6. The pole embedded in concrete is self containing. Its solar panels 69 atop the pole converts the daylight energy into the battery power pack 70 contained in the housing below the routing lights 29. The signal receiver/timer control unit 28 is activated by the signal from the RV causing the routing light 29 to come on for a pre-set time of five minutes, then turns back off. Also activated by the computer 41 on the RV is the horn 30 and remains on until the RV is well past the non-gated crossing. Of course, as mentioned previously the rotating light 22 and headlight 23 flash warning to on coming motorists of the approaching train. As the RV passes the road crosing, the engineer in the locomotive cab has the option to route the TV camera 15 left or right perhaps to record the license plate of a car that ignored the warnings and did not stop. The RV, after passing the crossing will encounter another magnet on the left side, but it does not activate an electrical circuit. It is used when the RV is approaching from the opposite direction.

In the previous scenarios, as the RV approaches a non-gated railroad crossing or gated crossing, if the engineer sees via the TV monitor 17 a vehicle stalled on the tracks he/she would manually apply the brakes on the train and the accelerometer 42 inside the console 19 would detect this and automatically signal for the RV to stop. In the above instance where the engineer was busy and did not see the stalled vehicle on the monitor, the RV would impact the vehicle. This impact would be sensed by the accelerometer 31 shown in FIG. 2 and deploy an airbag 32 shown in FIG. 1. The RV woud instantaneously send a signal to the locomotive cab. If the engineer has his/her braking switch 35 in the manual mode, a flashing light 33 and a piercing sound 34 would be emitted on the instrumentation console 19 urging the engineer to apply the train's brakes. If the switch 35 is in the automatic mode, the same indicators would occur, but the brakes would be applied automatically.

Figure 2:
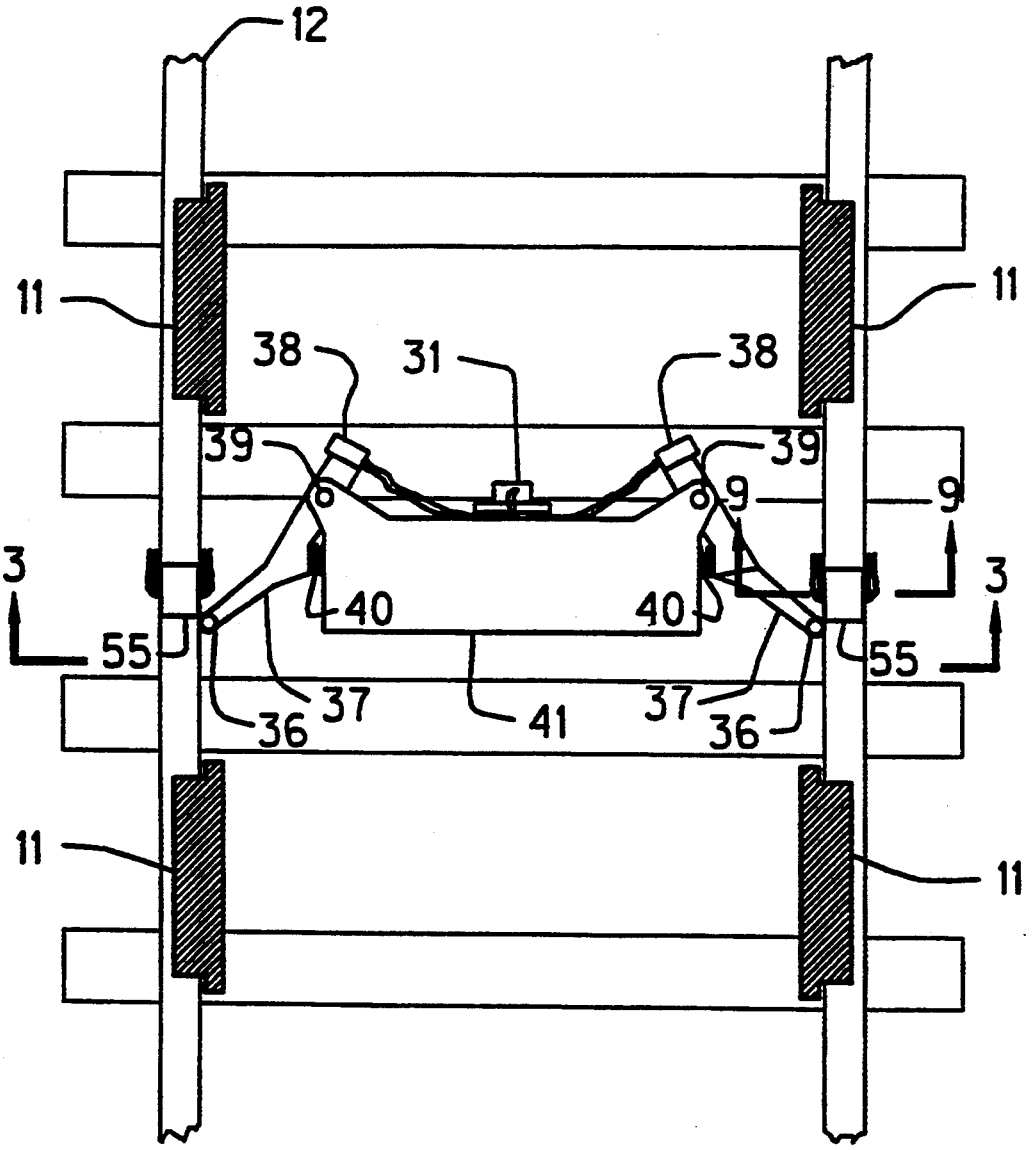
FIG. 2 is a top view of the housing containing computer, safety sensors, and mechanisms for electrical signal generation for broadcasting to the locomotive cab's instrumentation and display, taken along line 2—2 of FIG. 1.
Figure 3:
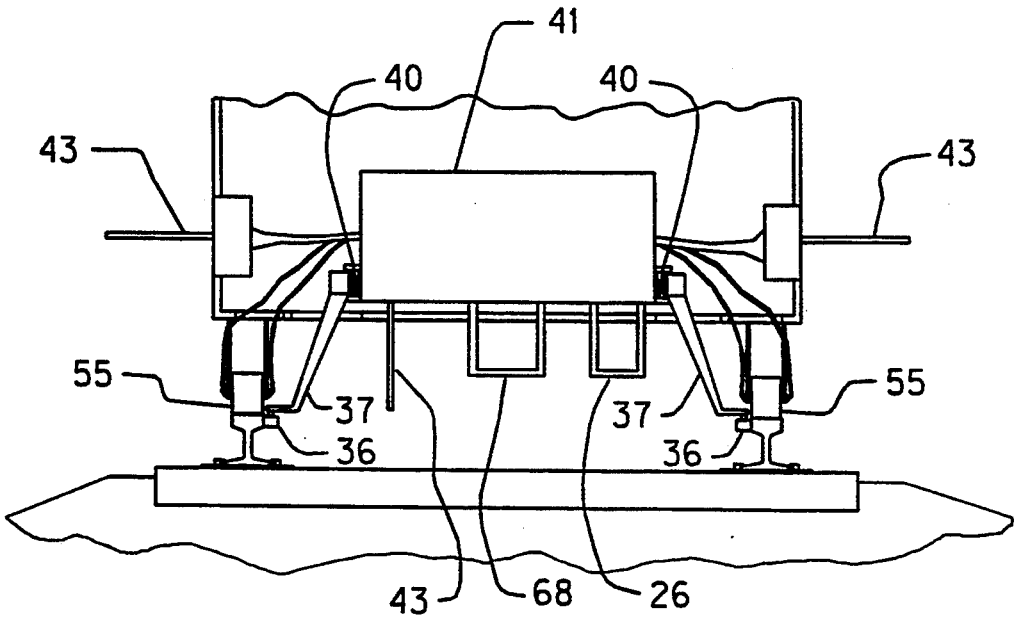
FIG. 3 is a sectional view taken along line 3—3 of FIG. 2 showing the safety sensors and mechanisms with the roller ends in contact with the rails being within the envelope of a flanged wheel.
Figure 5:
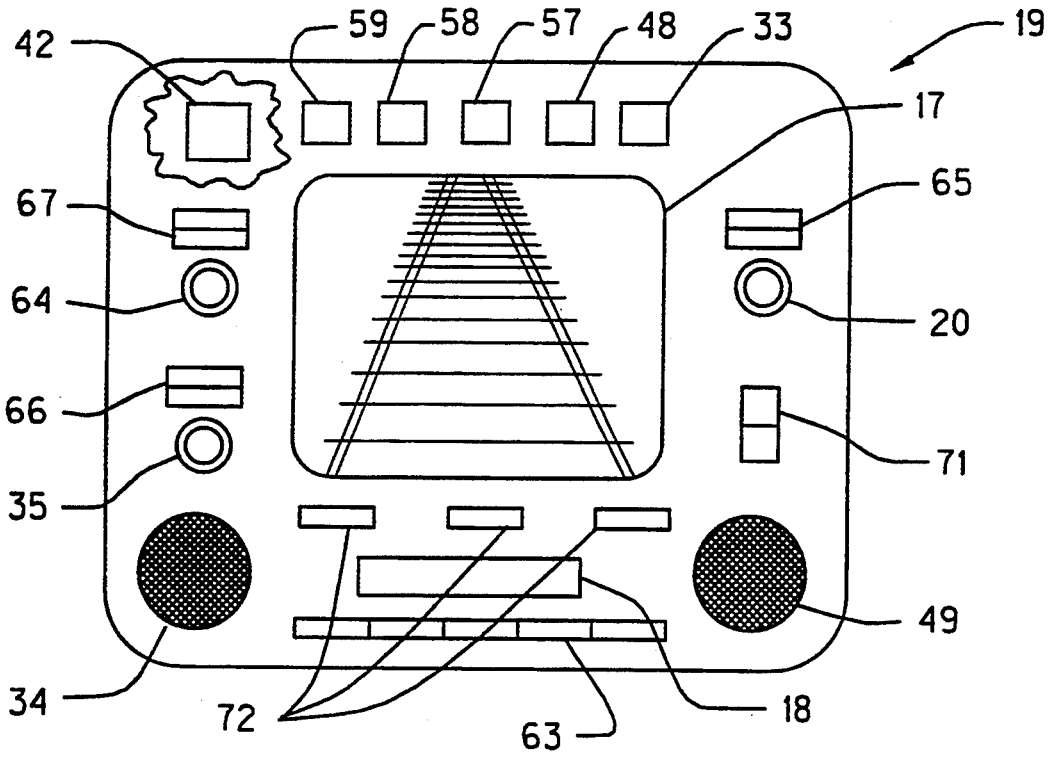
FIG. 5 is a view of the instrumentation, console, and television monitor/video cassette recorder in the locomotive cab for the engineer's switch mode manipulation and light and sound warning.

If the RV encounters a misalignment in the tracks that is significant, it is detected by the roller 36 mounted on the arm 37 with an accelerometer 38 mounted on the other side of the arm's pivot 39. The roller 36 is urged to stay against the inside of the rail by the compression spring 40 applying force against the pivot arm 37. This arrangement of parts apply for each rail and is shown in FIG. 2 and FIG. 3. If the rails are grossly misaligned, this will cause the RV to make sudden jerks and possibly derail. This sudden movement will be detected by the accelerometer 38 shown in FIG. 2 and a signal will be sent for application of brakes in the train following.

In the event that the RV has an engine failure, the RV's computer 41 which monitors RPM, etc., would detect this and automatically switch to emergency battery reserve to operate the electric drive mechanisms. It would also signal the train of this event through an audio recorded message broadcasted to the engineer on the speaker 34 and go immediately into a computer program regime for this event. The RV would gradually slow until the following train had caught up to it. Then the train would proceed to couple with the RV. At this point, the RV systems would be automatically shut off, drive mechanisms free wheeling, and the RV being pushed by the locomotive. On console 19, a recorded message emitted from the speaker 34 would announce switch modes have been re-set.

The coupling procedure, just stated, is also used by the RV and train when the train is nearing its destination under routine circumstances.

In the event the engineer stops the train without an RV initiated reason, an accelerometer 42 in the instrumentation console 19 would detect this and send a braking signal to the RV. The RV's computer 41 would with this input start braking until it came to a stop and remain with engine idling. At this point, the RV's computer would check two other inputs to confirm the train's action. The Global Position System (GPS) would input to the computer that there is no increasing or decreasing distances between the RV and train. The other input on the RV is a set of sound transducers 56 shown in FIG. 9. These transducers would input to the computer there is no increasing or decreasing sounds on the rails from the train. The RV would signal to the console light 59 of its stopping. If both of these signals contradicted the accelerometer 42 signal, the RV would go to the automatic coupling mode. Otherwise the RV would await the accelerometer 42 signaling a moving train, then resume its pace in front, once again confirming its action with other inputs.

Figure 9:
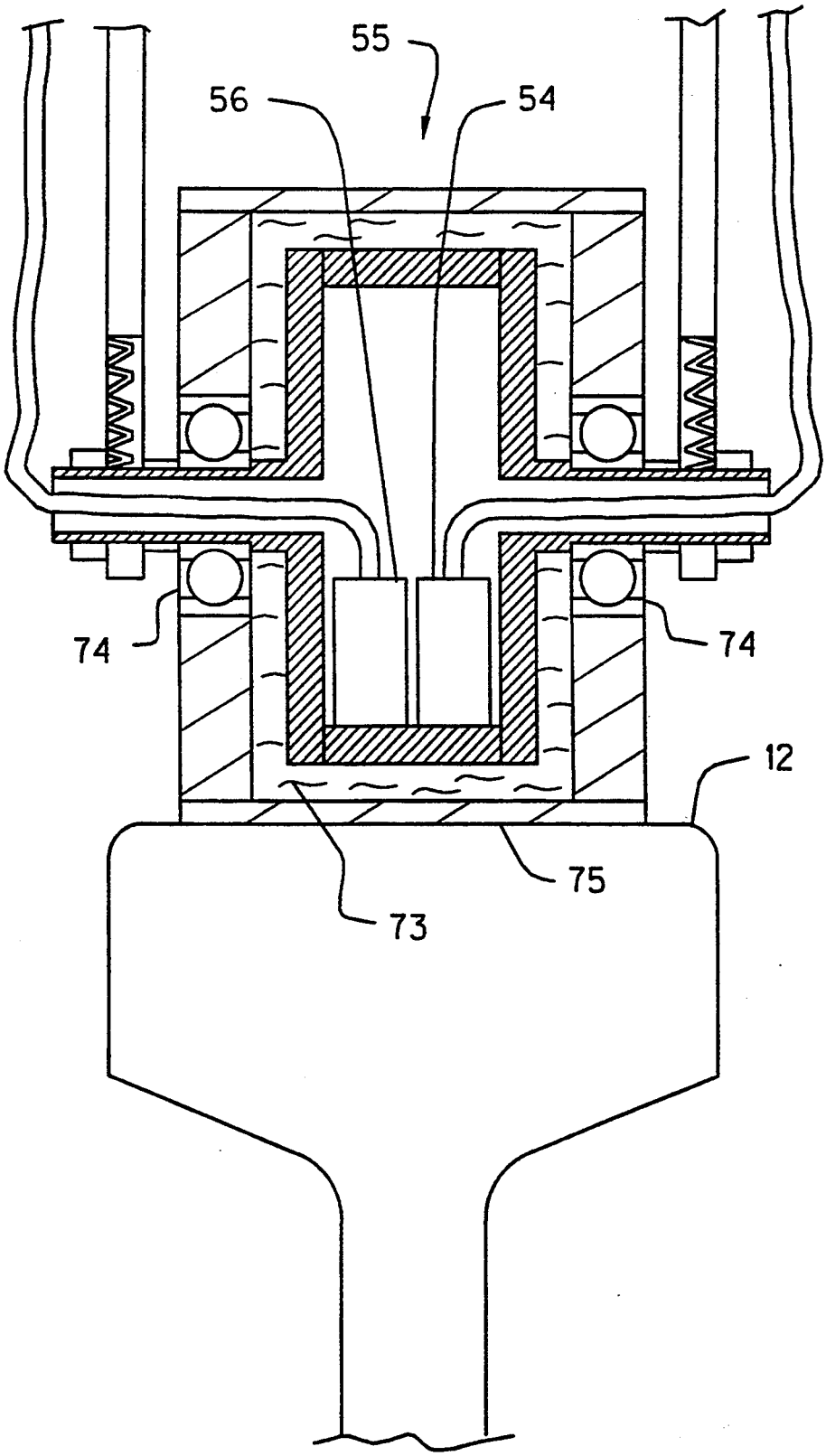
FIG. 9 is a sectional view taken along line 9—9 of FIG. 2 showing a roller atop the rail which houses the ultrasonic wave transducers fixed and surrounded by a suitable wave transmission fluid.

The transducer 56 shown in FIG. 9 (one for each rail) receives sound vibrations as the RV 10 travels the roadway 10. The normal sounds of the RV by itself are electronically eliminated by the computer program. The transducer listens and monitors the distant sounds of the train it is preceding. The computer program uses these sounds for control purposes. The computer program uses an input of decreasing vibrations, an accelerometer 42 input of slowing from the train, and a satellite GPS input of increasing distance as a signal to have the RV slow down. Conversely, if these inputs show the train is gaining, the RV speeds up. The same inputs control when the RV stops and idles as stated previously. Of the three inputs used by the computer 41, if one disagrees, the RV 10 goes to the automatic coupling mode program unless overridden by the engineer manually switching 20 to oppose. The actions of the RV are constantly transmitted to the locomotive cab's instrumentation console 19 indicator lights labeled slowing 57, speeding up 58 and stopping 59.

Figure 4:
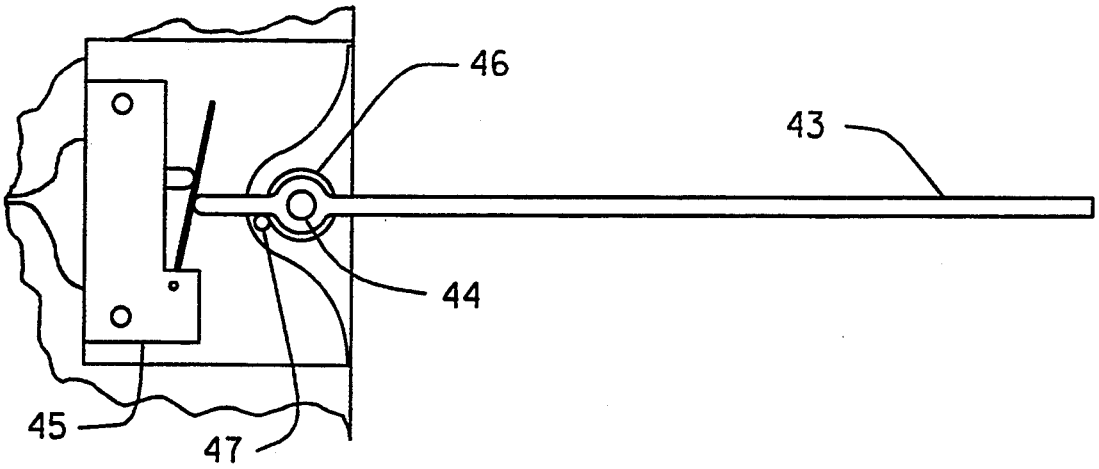
FIG. 4 is a partial view along line 4—4 of FIG. 1 which is typical in showing microswitch sensors for side, height, and roadbed train clearances.

Another scenario involving the RV 10 would be encountering some object that is on the crossties, at the side of the track, or above the track which violates the envelope of the train's clearances. If this occurs, a feeler rod 43 is extended from the RV 10 and mounted on a pivot 44 with the other end near the contact lever of a microswitch 45. A torsion spring 46 is mounted on the pivot pin 44 keeping its normal position against a stop 47. This arrangement of parts is shown in FIG. 4 and is typical of height, side, and undercarriage clearance sensors. Upon an object contacting a feeler rod 43 the microswitch 45 closes a circuit and a signal is processed through the RV's computer 41 and a signal is sent to the train's instrumentation console warning light 48 and an audible warning emitted through the speaker 34. The engineer can respond by rotating the TV camera 15 180° viewing what caused the feeler rod 43 warning and then decide what action should be taken. The TV camera, pan left, pan 180°, and pan right button controls 72 are timer controlled. The TV camera resumes viewing ahead after a short delay.

An additional feature of the robotic vehicle 10 is for a situation where the train and the RV have stopped a mile or two apart. In this situation, the engineer desires to talk to a person near the RV. he speaks into the microphone 49 on the instrumentation console 19 and a speaker 50 on the RV broadcasts his voice. The person at the RV can pick up the microphone 51 on the RV and talk to the engineer through the speaker 34 on the console.

Figure 8:
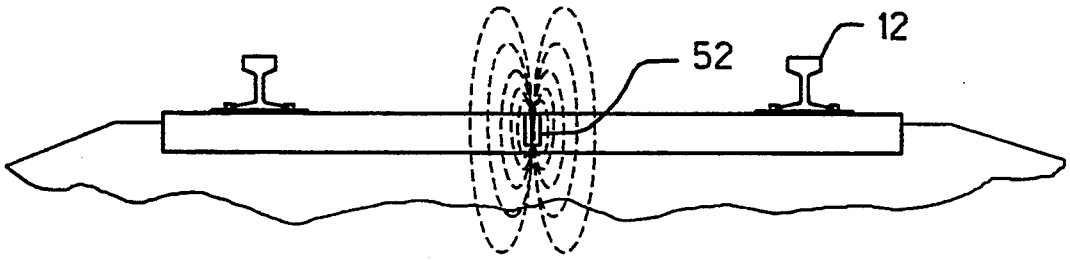
FIG. 8 is the same as FIG. 7 except the bar magnet is embedded in the middle of the crosstie and used at each end of bridges to initiate the ultrasonic wave system components.

A separate feature of the RV 10 that is safety related, but not an immediate hazard warning is an aid in bridge inspection. The RV as it encounters the magnetic field of the embedded magnet 52 as shown in FIG. 8, it switches the mode of transducer 54 to that of emitting ultrasonic waves and also receiving echoes of these waves. These transducers 54 shown in FIG. 9, one for each rail, are housed in roller assembly 55. The transducers shown are fixed in relation to the rail 12 and a fluid 73 provides a medium for the sound waves as the outer roller 75 revolves on its bearings 74 and contacting the rails. The switching process uses the same method of a wire 26 as described for non-gated crossing activation except the wire 68 on the RV for this system is in the middle of the vehicle as shown in FIG. 3. The magnet 52 as shown in FIG. 8 is at the beginning of the bridge structure. The echo patterns received by the transducers 54 are immediately electronically processed through the computer 41 and sent via satellite plate antenna (receiver/transmitter) unit 53 to a satellite for relaying this data to a central ground station. The data is received and recorded along with the bridge location using global positioning satellite system. Other data is recorded as well, date, time, RV serial number, speed, etc. This record becomes the bridge's structural signature. This echo pattern is not a structural integrity inspection, but is a reference for comparison of significant structural changes. The next time the RV crosses the same bridge, the new data is compared with the original data using a computer program at the central ground station. If a bridge member is missing, this causes a significant difference in the echo patterns. Upon detecting this difference the computer program at the central ground station would schedule an inspection crew to be sent to examine the bridge. The normal sounds produced by the RV as it travels across the bridge would be in the RV's computer 41 memory and would be electronically eliminated by the compute program in the bridge echo pattern sent to the central ground station. When the RV reaches the end of the bridge it encounters another embedded magnet 52. This switches off the emitting and receiving mode of the transducer 54 to its normal receiving mode. In this mode, the computer program electronically eliminates the sound of the RV and that of the train following and listens for any new sounds. If it detects a substantial new sound set which fit the parameters of an on coming train, the RV 10 sends warnings to the train it precedes and via satellite to the central ground station for relay of the warning to the approaching train.

It is claimed:

1. A railway safety signalling system, comprising:

a self-propelled locomotive vehicle for traversing a railway track, a self-propelled robotic vehicle for also traversing the track, said robotic vehicle maintaining a predetermined distance from said locomotive vehicle at selected locations along the track, said robotic vehicle comprising sensor means and trigger means operatively connected to control means on the robotic vehicle, said sensor means including an accelerometer for sensing impact with an obstacle, and a video camera means for relaying video pictures from the robotic vehicle to the locomotive vehicle, and a signal means located adjacent a highway crossing of the track, said signal means comprising a light means controlled by a timer means, wherein upon actuation of said trigger means by a member located in the track, said control means initiates activation of said light means for a predetermined time period controlled by said timer means.

2. A railway system as claimed in claim 8, wherein said sensor means further comprises a sound detecting device, said sound detecting device including a fixed center housing surrounded by a liquid medium which is sealed with respect to a roller casing rotatably connected to said housing by bearings.

3. A railyway system as claimed in claim 8, wherein said locomotive vehicle includes display means for displaying braking warning signals in response to impact signals transmitted to said locomotive vehicle from said robotic vehicle in response to a sensed impact from said accelerometer.

4. A railway system as claimed in claim 3, wherein said display means further includes a video display for displaying said video pictures, and a video recorder for recording said video pictures.

5. A railway system as claimed in claim 1, wherein said sensor means further comprises a vehicle outline sensor, said vehicle outline sensor including a rod pivotally connected to the robotic vehicle and operatively connected to a switch means, wherein impact with an object by said rod activates said switch means for alerting said control means and said locomotive vehicle of a possible path obstruction.

* * * * *